US007201310B2

(12) United States Patent
Kawamata

(10) Patent No.: US 7,201,310 B2
(45) Date of Patent: Apr. 10, 2007

(54) SETTING APPARATUS FOR REMOTE MONITORING AND CONTROLLING SYSTEM

(75) Inventor: Motosugu Kawamata, Tsu (JP)

(73) Assignee: Matsushita Electric Works, Ltd., Osaka (JP)

( * ) Notice: Subject to any disclaimer, the term of this patent is extended or adjusted under 35 U.S.C. 154(b) by 0 days.

(21) Appl. No.: 11/404,874

(22) Filed: Apr. 17, 2006

(65) Prior Publication Data

US 2006/0231631 A1 Oct. 19, 2006

(30) Foreign Application Priority Data

Apr. 15, 2005 (JP) ..... 2005-118646

(51) Int. Cl.
*G06F 17/00* (2006.01)
*G06F 7/00* (2006.01)
*G06K 7/10* (2006.01)

(52) U.S. Cl. ..... 235/375; 235/376; 235/472.01; 340/825.72; 340/3.1

(58) Field of Classification Search ..... 235/375, 235/376, 472.01; 340/3.1, 825.69, 825.72
See application file for complete search history.

(56) References Cited

U.S. PATENT DOCUMENTS 6,914,888 B1 * 7/2005 Iselt ..... 370/310
2001/0014832 A1 * 8/2001 Hatemata et al. ..... 700/16
2006/0012488 A1 * 1/2006 Hilbrink et al. ..... 340/825.69
2006/0022791 A1 2/2006 Yoshimura
2006/0025084 A1 2/2006 Kawamata

FOREIGN PATENT DOCUMENTS

JP 07099715 A * 4/1995
JP 11-150770 6/1999
JP 11-298978 10/1999

OTHER PUBLICATIONS

English Language Abstract of JP 11-150770.
English Language Abstract of JP 11-298978.

* cited by examiner

*Primary Examiner*—Akm Ullah
*Assistant Examiner*—Adrian Hruszkewycz
(74) *Attorney, Agent, or Firm*—Greenblum & Bernstein, P.L.C.

(57) ABSTRACT

A setting apparatus for a remote monitoring and controlling system allows a decrease in the size of a portable unit. The setting apparatus includes a stationary unit fixed to an installation surface and a portable unit detachably attached to the stationary unit. A battery receiving portion for receiving a battery is protruded backwardly from the rear surface of the portable unit. By receiving the battery receiving portion of the portable unit in a reception concave portion of the stationary unit and engaging a coupling convex portion with a coupling concave portion of the battery receiving portion, the portable unit is detachably attached to the stationary unit. Since the coupling concave portion for coupling to the stationary unit is formed in the battery receiving portion of the portable unit, the portable unit has a decreased size, compared with a case when the portion coupled to the stationary unit is provided independent of the battery receiving portion.

6 Claims, 12 Drawing Sheets

SETTING APPARATUS FOR REMOTE MONITORING AND CONTROLLING SYSTEM

BACKGROUND

1. Technical Field

The present invention relates to a setting apparatus for a remote monitoring and controlling system.

2. Related Art

Conventionally, there has been provided an address setting apparatus and a pattern setting apparatus for a remote monitoring and controlling system comprising an operation device having switches in which a specific address is set for each switch, a control device connected with loads in which a specific address is set for each load, and a transmission controller transmitting and receiving a transmission signal between the operation device and the control device through a signal line to which the operation device and the control device are branched, in manner of a time division multiple transmission, generating control data for controlling the loads based on monitoring data received from the operation device when the switches are operated, and transmitting the control data to the control device connected with the loads associated with the operated switches on the basis of predetermined relation data, wherein the address setting apparatus is to set the addresses in the operation device and the control device, and the pattern setting apparatus is to generate relation data for controlling simultaneously the number of loads by means of operation of one switch, and to set the relation data by transmitting to the transmission controller.

Here, since the addresses corresponding to the switches and the addresses corresponding to the loads could not be set through the signal line but could be set directly to the operation device or the control device, the address setting apparatus is generally portable and radio signals are used for communication between the address setting apparatus and the operation device and the control device (for example, see Patent Document 1).

On the other hand, since the relation data could be set directly to the transmission controller through the signal line, the pattern setting apparatus is fixed to an installation surface and is connected to the signal line (for example, see Patent Document 2).

In this way, since the address setting apparatus and the pattern setting apparatus are different from each other in configuration, it is necessary to install the address setting apparatus and the pattern setting apparatus independently. In addition, the address setting apparatus could be easily lost, if a holder or a specific space for holding the address setting apparatus is not additionally prepared.

Therefore, the inventor suggests a setting apparatus for a remote monitoring and control system including a stationary unit fixed to an installation surface and a portable unit which is detachably attached to the stationary unit and can be portable by detaching the portable unit from the stationary unit. In the state that the portable unit is attached to the stationary unit, the portable unit is connected to the signal line through the stationary unit and serves as a pattern setting apparatus. In the state that the portable unit is detached from the stationary unit, the portable unit serves as an address setting apparatus.

[Patent Document 1] Japanese Patent Laid-open No. H11-150770

[Patent Document 2] Japanese Patent Laid-open No. H11-298978

Here, in order to couple the portable unit to the stationary unit, a method of providing the coupling portion, which is protruded from other position of the portable unit for coupling to the stationary unit, to the portable unit can be considered. However, in this method, the size of the portable unit is increased by the size of the coupling portion.

SUMMARY

The present invention relates to solve the above-mentioned problems. An object of the invention is to provide a setting apparatus for a remote monitoring and controlling system which can allow decrease in size of a portable unit.

According to a first aspect of the present invention, there is provided a setting apparatus for a remote monitoring and controlling system comprising an operation device having switches in which a specific address is set for each switch, a control device connected with loads in which a specific address is set for each load, and a transmission controller transmitting and receiving a transmission signal between the operation device and the control device through a signal line to which the operation device and the control device are branched, in manner of a time division multiple transmission, generating control data for controlling the loads based on monitoring data received from the operation device when the switches are operated, and transmitting control data to the control device connected with the loads associated with the operated switches on the basis of predetermined relation data, the setting apparatus being connected to the signal line, generating the relation data for controlling simultaneously a number of loads by means of operation of one switch, and setting the relation data by transmitting the relation data to the transmission controller, wherein the setting apparatus comprises a stationary unit fixed to an installation surface and a portable unit which is detachably attached to the stationary unit and can be carried by detaching the portable unit from the stationary unit, wherein the stationary unit includes a base having a receiving concave portion for receiving a part of the portable unit at least in the state that the portable unit is attached to the stationary unit and a fixing portion fixed to the installation surface, and connection means for electrically connecting the portable unit to the signal line, wherein the portable unit includes operation means for inputting addresses and the relation data according to manual operation, control means for generating the addresses and the relation data on the basis of the input to the operation means, wireless transmission means for transmitting the addresses to the operation device and the control device as a radio signal under the control of the control means, connection means being electrically connected to the signal line through the connection means of the stationary unit in the state that the portable unit is attached to the stationary unit, wired transmission means for transmitting the relation data to the transmission controller through the connection means of the stationary unit, the connection means of the portable unit, and the signal line under the control of the control means, and a housing which receives a battery for supplying power to the respective portions of the portable unit and the control means and exposes the operation means at an exposing position in the state that it is fixed to the base of the stationary unit, wherein the housing includes a battery receiving portion for receiving the battery and an outer circumferential surface which has a size slightly smaller than the inner circumferential surface of the receiving concave portion formed at the base of the stationary unit to be received in the receiving concave portion in the state that the portable unit is attached to the stationary unit, and wherein a coupling portion is provided on the inner circumferential surface of the receiving concave portion, a coupling portion is provided on the outer circumferential surface of the battery receiving portion, and the housing of the portable unit is detachably attached to the base of the stationary unit by means of the coupling between the coupling portions.

According to the configuration described above, it is possible to further decrease the size of the portable unit, compared with the case that the portion in which the coupling portion is disposed in the portable unit is different from the battery receiving portion.

In a second aspect of the invention, the base of the stationary unit according to the first aspect may include a base body being provided with the fixing portion and being fixed to the installation surface and a base cover having a receiving concave portion formed therein, and the base body and the base cover may be detachably coupled to each other by the use of coupling means provided in at least one of the base cover and the base body.

According to the configuration described above, since the base body can be used as a part for fixing the operation device having a size greater than that of the portable unit to the installation surface, it is possible to reduce the whole manufacturing cost for the remote monitoring and controlling system.

In a third aspect of the invention, the base of the stationary unit according to the first aspect may include only one component.

According to the configuration described above, it is possible to decrease the number of components of the stationary unit and to reduce the manufacturing cost, in comparison with the second aspect.

In a fourth aspect of the invention, the coupling portion of the base according to any one of the first to third aspects may include a coupling convex portion protruded to the inside of the receiving concave portion from the inner circumferential surface of the receiving concave portion and the coupling portion of the housing may include a coupling concave portion provided on the outer circumferential surface of the battery receiving portion.

BEST MODE FOR CARRYING OUT THE INVENTION

Hereinafter, an exemplary embodiment for carrying out the present invention will be described with reference to the drawings.

Figure 1:
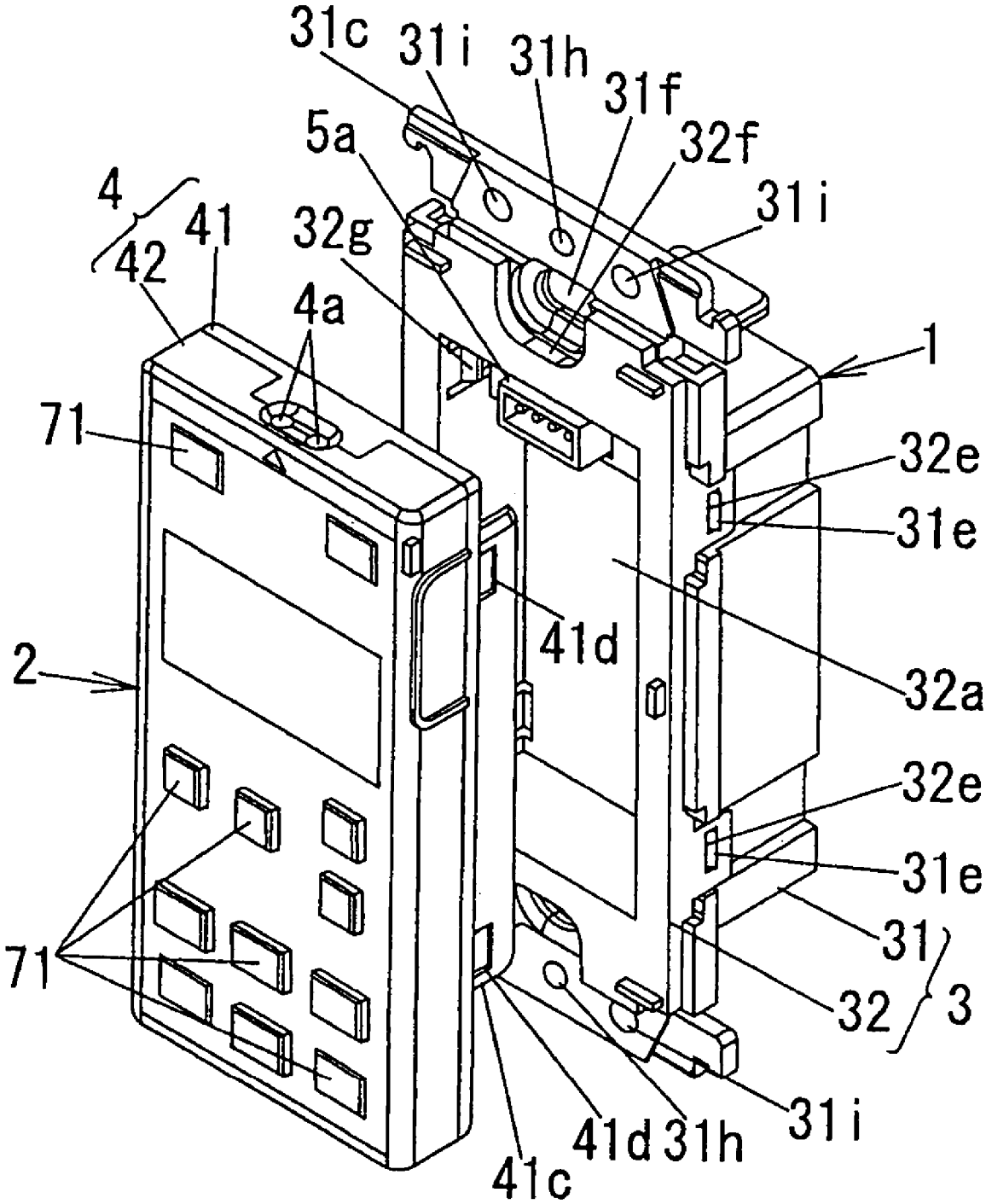
FIG. 1 is a perspective view illustrating an embodiment of the present invention.

The exemplary embodiment, as shown in FIG. 1, includes a stationary unit 1 fixed to an installation surface (not shown) and a portable unit 2 detachably attached to the stationary unit 1. In the state that the portable unit 2 is attached to the stationary unit 1, the portable unit 2 is electrically connected to a signal line L (see FIG. 5). Hereinafter, the upward direction and the downward direction are set with reference to FIG. 1, wherein the left-downward and right-upward directions in FIG. 1 are referred to as forward and backward directions and the left-upward and right-downward directions are referred to as left and right directions, respectively.

Figure 2:
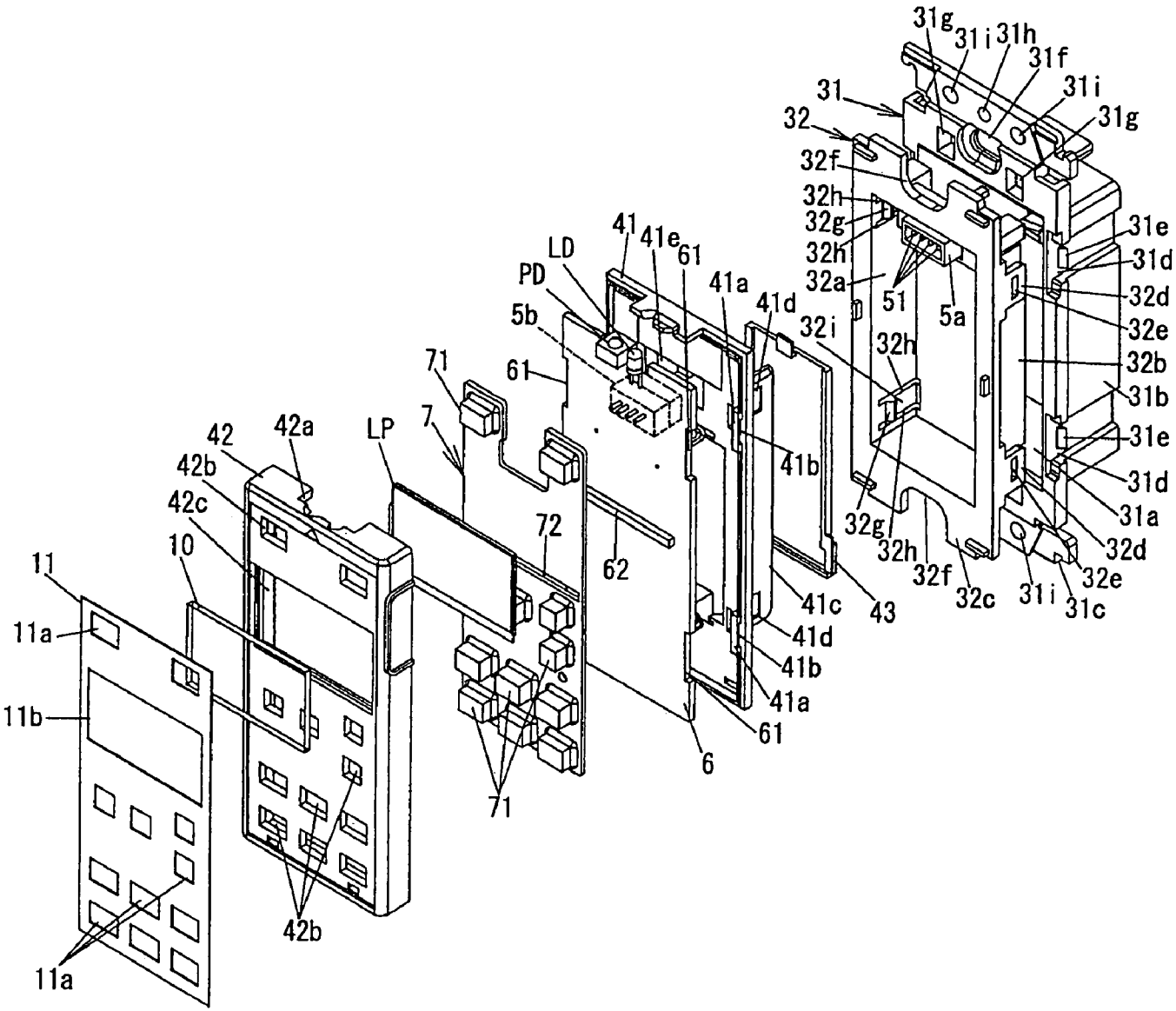
FIG. 2 is an exploded perspective view illustrating the embodiment.

As shown in FIG. 2, the stationary unit 1 includes a base having a base body 31 which is buried in and fixed to a burial hole (not shown) of the installation surface and a base cover 32 coupled to the front side of the base body 31. The base body 31 and the base cover 32 are made of, for example, a synthetic-resin molded product, each of which has a rectangular-hexahedron main body 31*b* and 32*b* having a receiving concave portion 31*a* and 32*a* on the front surface and a flange portion 31*c* and 32*c* protruded outwardly from the front end of the main body 31*b* and 32*b* along an open surface of the receiving concave portion 31*a* and 32*a*. Both lateral sides of the base body 31 are vertically provided with two concave portions 31*d* opened in the forward and backward directions, and a coupling projection 31*e* is protruded outwardly from the front end of the bottom of each concave portion 31*d*. Two coupling pieces 32*d* are protruded in parallel from both lateral sides of the flange portions 32*c* of the base cover 32, and a coupling hole 32*e* is laterally formed through each coupling piece 32*d*. Then, the base body 31 and the base cover 32 are coupled to each other by receiving the main body 32*b* of the base cover 32 in the receiving concave portion 31*a* of the base body 31 and inserting the coupling projections 31*e* into the coupling holes 32*e* of the coupling pieces 32*d* of the base cover 32 which is inserted into the concave portion 31*d* from the front side of the base body 31. A connector 5*a* having contacts 51 electrically connected to the signal lien L is provided in the receiving concave portion 31*a* of the base body 31, and a hole for forwardly exposing the connector 5*a* is formed through the bottom of the receiving concave portion 32*a* of the base cover 32.

The base body 31 of the stationary unit 1 is formed in the shape corresponding to an installation frame manufactured in advance in a large-angle continuous use type defined in JIS C 8304. Longitudinally long box holes 31*f* through which screws for coupled to a buried box (not shown) buried in the installation surface are inserted are formed to pass through the upper and lower ends of the flange portions 31*c* of the base body 31. When the installation surface is formed out of a panel, hooking holes 31*g* for hooking and fixing insertion members (not shown) between the panel and the flange portions 31*c* are formed through both lateral sides of the box holes 31*f*. Plate holes 31*h* through which screws for fixing a plate are inserted are formed through the upper end and the lower end of the flange portion 31*c* at positions more apart from the concave portion than from the box holes 31*f*. Direct installation holes 31*i* through which direct installation screw coupled to the installation surface are inserted are formed through both lateral sides of the plate holes 31*h*. That is, the flange portion 31*c* corresponds to the fixing portion in the claims. Notched portions 32*f* for forwardly exposing the box holes 31*f* are formed in the upper end and the lower end of the flange portion 32*c* of the base cover 32.

The portable unit 2 includes a housing 4 having a cover 42 formed in a rectangular hexahedron shape of which the rear surface is opened and a body 41 for covering the rear side of the cover 42. The body 41 and the cover 42 are formed out of, for example, a synthetic-resin molded product. Coupling projections 41*a* are protruded forwardly from both lateral ends of the body 41, respectively, and coupling holes 41*b* are formed through the outer surfaces of the coupling projections 41*a*, respectively. Coupling projections (not shown) are protruded inwardly from both lateral inner surfaces of the cover 42. The body 41 and the cover 42 are coupled to each other by inserting the coupling projections into the coupling holes 41*b*.

A battery receiving portion 41*c* formed with a size slightly smaller than that of the receiving concave portion 32*a* is protruded backwardly from the rear surface of the body 41. Coupling concave portions 41*d* are formed through the upper and lower ends of both lateral surfaces of the battery receiving portion 41*c*. In the base 3 of the stationary unit 1, coupling convex portions 32*g* are protruded to the inside of the receiving concave portion 32*a* from both lateral inner surfaces of the receiving concave portion 32*a* of the base cover 32. Slits 32*h* long in the forward and backward directions are formed in the upper and lower ends of each coupling convex portion 32*g*, respectively. Since bending portions 32*i* inserted into the slits 32*h* are elastically deformed, the coupling convex portions 32*g* can elastically vary the amount of the receiving concave portion 32*a* protruded to the inside of the receiving concave portion 32*a*. By receiving the battery receiving portion 41*c* of the portable unit 2 in the receiving concave portion 32*a* of the stationary unit 1 and inserting the coupling convex portions 32*g* into the coupling concave portions 41*d*, the portable unit 2 is detachably attached to the stationary unit 1. In addition, the portable unit 2 includes a battery cover 43 detachably coupled to the battery receiving portion 41*c* to cover the opening of the rear side of the battery receiving portion 41*c*.

Figure 3:
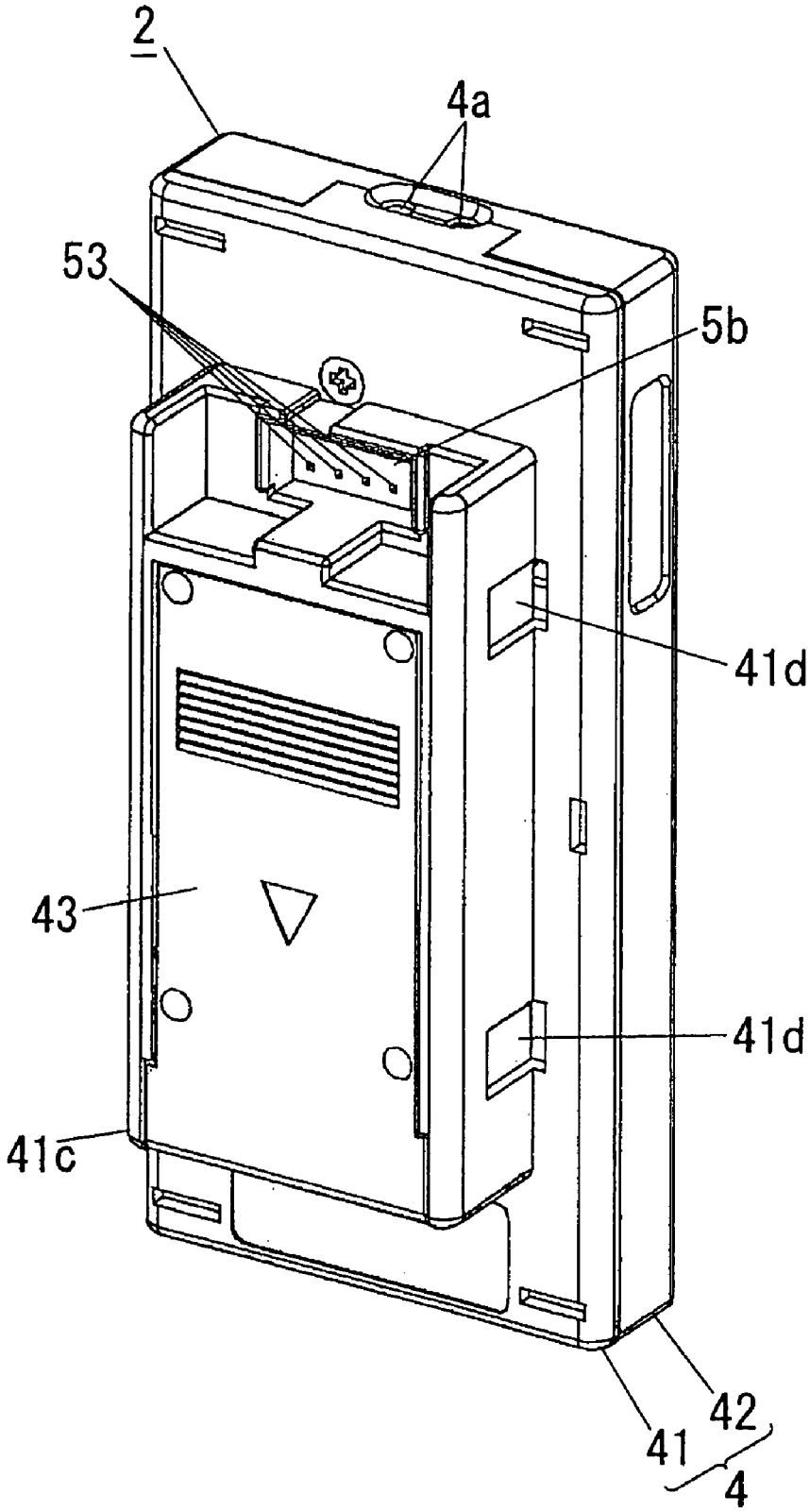
FIG. 3 is a perspective view illustrating a portable unit according to the embodiment as seen from the rear side.

A printed circuit board 6 is received in the housing 4 of the portable unit 2 with its thickness direction set to the forward and backward direction. A connector 5*b* as a connecting portion is mounted on the rear surface of the printed circuit board 6 and as shown in FIG. 3, a connector inserting hole 41*e* for backwardly exposing the connector 5*b* is formed through the body 41. A plurality of pin inserting holes 53 (four in the figure) are formed in the rear surface of the connector 5*b* and contacts 52 (see FIG. 4) are held in the pin inserting holes 53. In the portable unit 2 is attached to the stationary unit 1, the contacts 51 of the connector 5*a* of the stationary unit 1 are inserted into the pin inserting holes 53 of the connector 5*b* of the portable unit 2 so as to be electrically connected to the contacts 52 (see FIG. 4). Here, the printed circuit board 6 of the portable unit 2 is electrically connected to the signal line L through the connectors 5*a* and 5*b*. That is, the connector 5*a* of the stationary unit 1 serves as connection means, and the connector 5*b* serves as the other connection means. Two concave portions 61 are formed in both lateral ends of the printed circuit board 6, respectively, the printed circuit board 6 is positioned with respect to the body 41 by inserting the coupling projections 41*a* into the concave portions 61.

Figure 4:
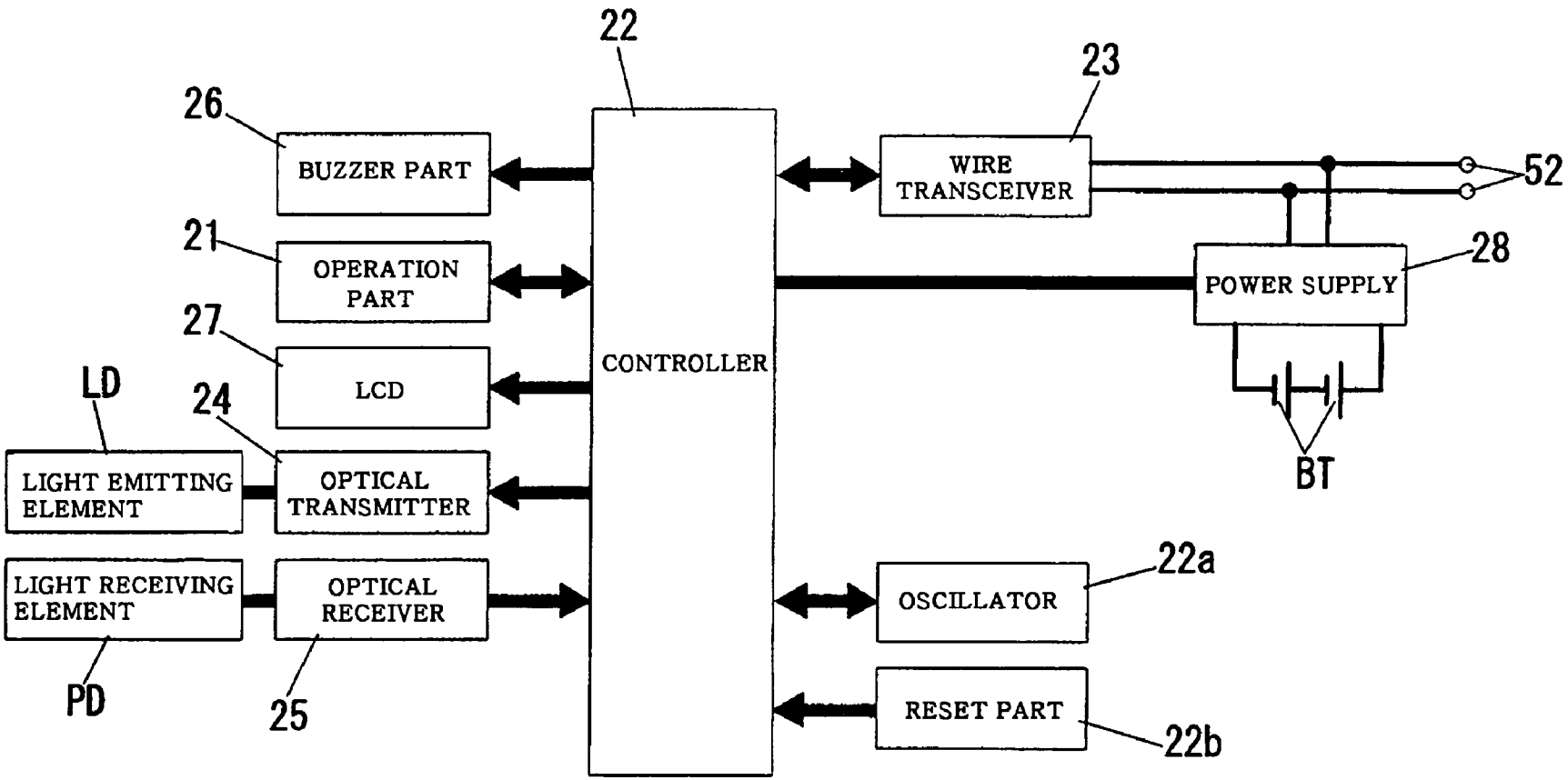
FIG. 4 is a block diagram illustrating a configuration of the portable unit according to the embodiment.

As shown in FIG. 4, the printed circuit board 6 is mounted with an operation part 21 for inputting addresses and relation data by means of manual operation, a controller 22 including, for example, a micro computer so as to generate the addresses and the relation data on the basis of the input to the operation part 21, an oscillator 22*a* for supplying a clock signal to the controller 22, a reset part 22*b* for resetting the controller 22, a wire transceiver 23 as wired transmitting and receiving means for transmitting the relation data to a transmission controller (not shown) through the connectors 5*a* and 5*b* and the signal line L (see FIG. 5) under the control of the controller 22, a light emitting element LD such as a light emitting diode for generating infrared rays as radio signals, an optical transmitter 24 for driving the light emitting element LD under the control of the controller 22 to transmit the addresses to an operation device (not shown) and a control device (not shown) by the use of infrared rays (that is, the optical transmitter constitutes wireless transmitting and receiving means along with the light emitter LD), a light receiving element PD such as a photo diode for receiving the signals as infrared rays transmitted from the operation device or the control device, a optical receiver 25 for converting and inputting the output of the light receiving element PD to the controller 22, a buzzer part having a buzzer (not shown) so as to ring the buzzer under the control of the controller 22, a liquid crystal display 27 having a liquid crystal panel LP so as to display various data under the control of the controller 22, and a power supply 28 for supplying power to the respective elements of the portable unit 2.

The portable unit 2 includes a battery BT. The portable unit 2 is supplied with power through the signal line L from the power supply 28 in the state that the portable unit 2 is attached to the stationary unit 1 and is supplied with power from the battery BT in the state that the portable unit 2 is detached from the stationary unit 1.

The operation part 21 includes a rubber switch 7 having a plurality of push buttons 71 as operation means formed integrally with a surface of a flat panel and an input processor (not shown) for generating operation signals based on the switching of the contacts disposed inside the push buttons 71 and inputting the generated operation signals to the controller 22.

A laterally long connecting hole 72 is formed through the center in the vertical direction of the rubber switch 7. A laterally long connecting projection 62 is protruded from the front surface of the printed circuit board 6. Accordingly, by inserting the connecting projection 62 into the connection hole 72, the rubber switch 7 is positioned with respect to the printed circuit board 6. Terminals (not shown) are disposed on the inner circumference of the connecting hole 72 and the outer circumference of the connecting projection 62, respectively, and by electrically connecting the terminals to each other when the connecting projection 62 is inserted into the connecting hole 72, the printed circuit board 6 and the rubber switch 7 are electrically connected to each other.

The light emitting element LD and the light receiving element PD are mounted on the upper end of the printed circuit board 6 with a light emitting surface and the light receiving surface directed to the upside. Notched portions 42*a* for forming openings, which are opened to the back side to expose the light emitting surface of the light emitting element LD and the light receiving surface of the light receiving element PD, between the body 41 and the cover 42 are formed on the upper end of the cover 42 of the housing 4.

A plurality of push-button inserting holes 42*b* into which the push buttons 71 are inserted and a window hole 42*c* for exposing the liquid crystal panel LP are formed in the forward and backward direction through the cover 42 of the housing 4. The window hole 42*c* is covered with a window member 10 made of a transparent material. A step allowing the rear opening to be smaller than the front opening is formed on the inner circumferential surface of the window hole 42*c*, thereby preventing the window member 10 from separation to the back side by the step. A name plate 11 is attached to the front surface of the cover 42. A plurality of push-button inserting holes 11*a* into which the push buttons 71 are inserted and a window hole 11*b* for exposing the liquid crystal panel LP are formed in the forward and backward directions through the name plate 11. The window hole 11*b* of the name plate 11 is smaller than the window member 10, thereby preventing the window member 10 from separation to the front side. Marks indicating functions of the push buttons 71 are attached to the name plate 11.

Figure 5:
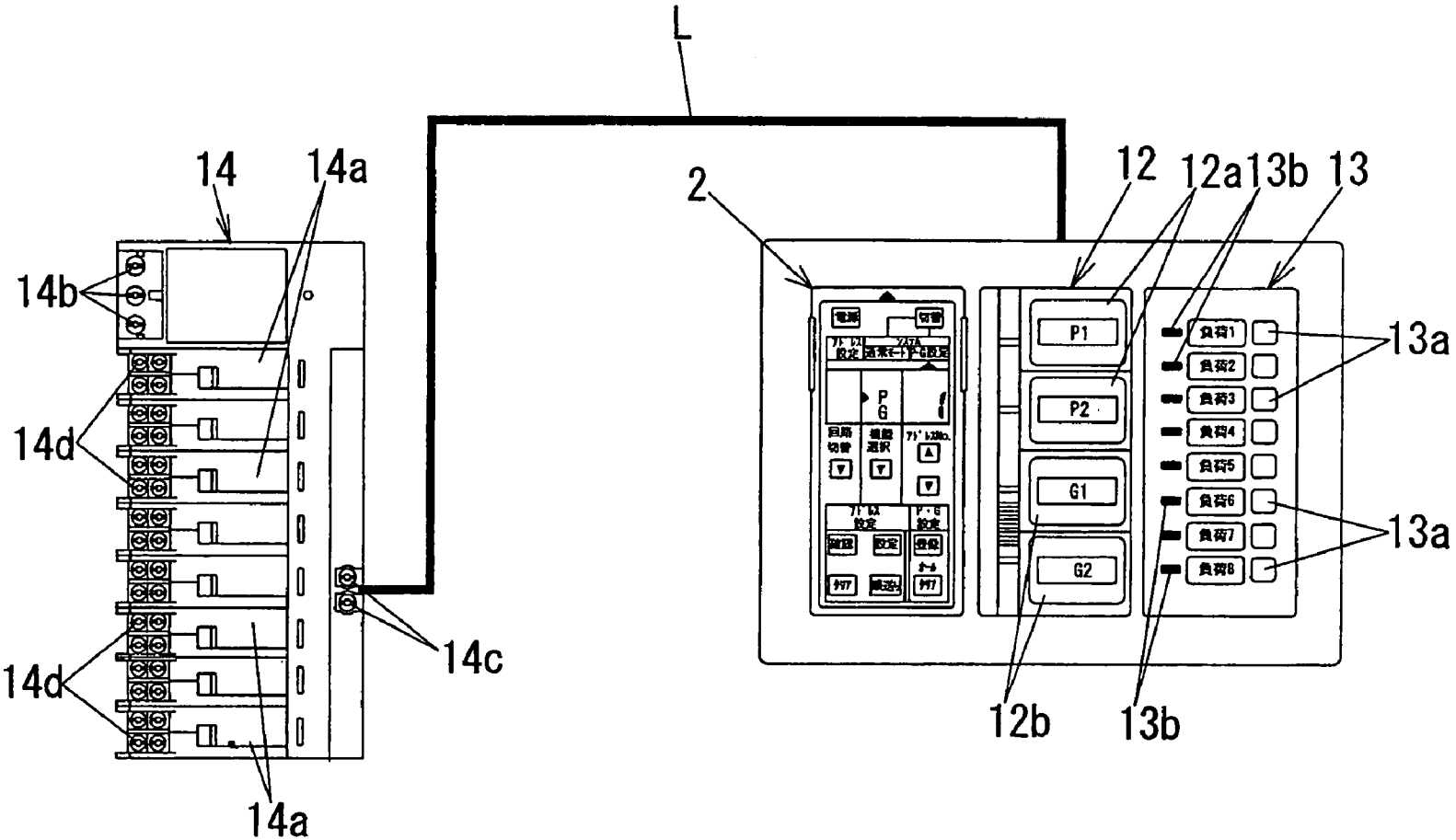
FIG. 5 is an explanatory diagram illustrating a modified example of using the embodiment.

In the exemplary embodiment, as shown in FIG. 5, a PG operation device 12 and an individual operation device 13 as the operation device are provided together and are connected to a transmission unit 14 through the signal line L.

The PG operation device 12 has two pattern switches 12*a* used for the pattern control for simultaneously changing a number of loads corresponding in advance to the relation data to control states corresponding to the loads and two group switches 12*b* used for the group control for simultaneously turning on and off a number of loads corresponding in advance to the relation data. The individual operation terminal 13 is designed to individually control the loads and has eight individual switches 13*a* corresponding to the loads, light emitting elements for indication (not shown) for indicating load states with lighting states corresponding to the respective loads, and indication windows 13*b* for displaying light of the light emitting elements for indication. When the pattern switches 12*a*, the group switches 12*b*, or the individual switches 13*a* are operated, the PG operation device 12*b* and the individual operation device 13 generate monitoring data corresponding to the pattern switches 12*a*, the group switches 12*b*, or the individual switches 13*a* and transmit the generated monitoring data to the transmission unit 14 through the signal line L.

Eight relays 14*a* for turning on and off the power supply to the loads are provided to the transmission unit 14. The transmission unit 14 is supplied with power through, for example, a single-phase 3-line cable (not shown) connected to the power supply terminals 14*b* and turns one and off the loads connected to the terminals of the relays 14*a* by controlling the relays 14*a* on the basis of the monitoring data transmitted through the signal line L connected to the signal terminals 14*c*. That is, the transmission unit 14 serves as a transmission controller and a control device.

Now, a procedure of setting the addresses and a procedure of setting the relation data according to the exemplary embodiment are described. In the following description of the procedures, different names and reference numerals denote the push buttons 71.

Figure 6:
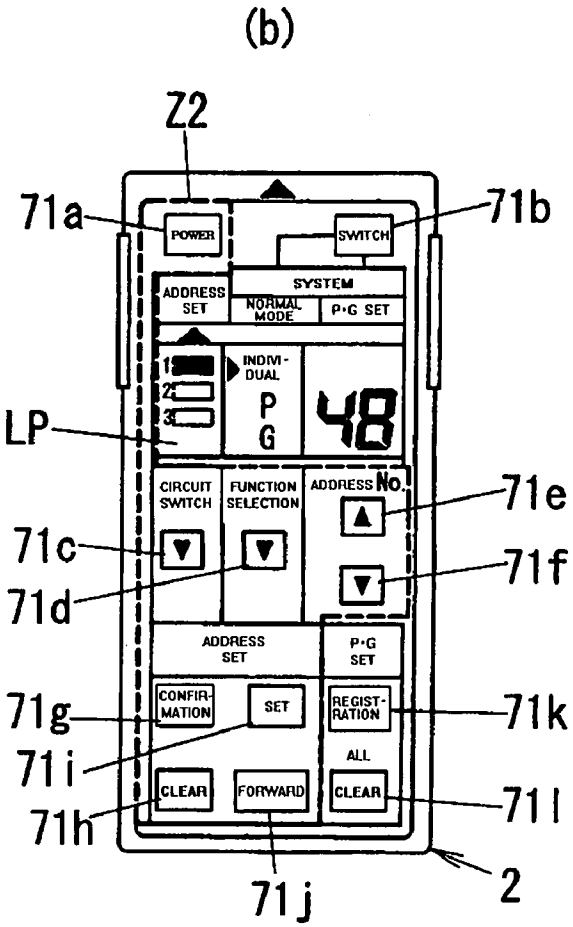
FIG. 6(*a*) is a front view illustrating the portable unit according to the embodiment when it is attached to a stationary unit and FIG. 6(*b*) is a front view illustrating the portable unit according to the embodiment when it is detached from the stationary unit.
Figure 6:
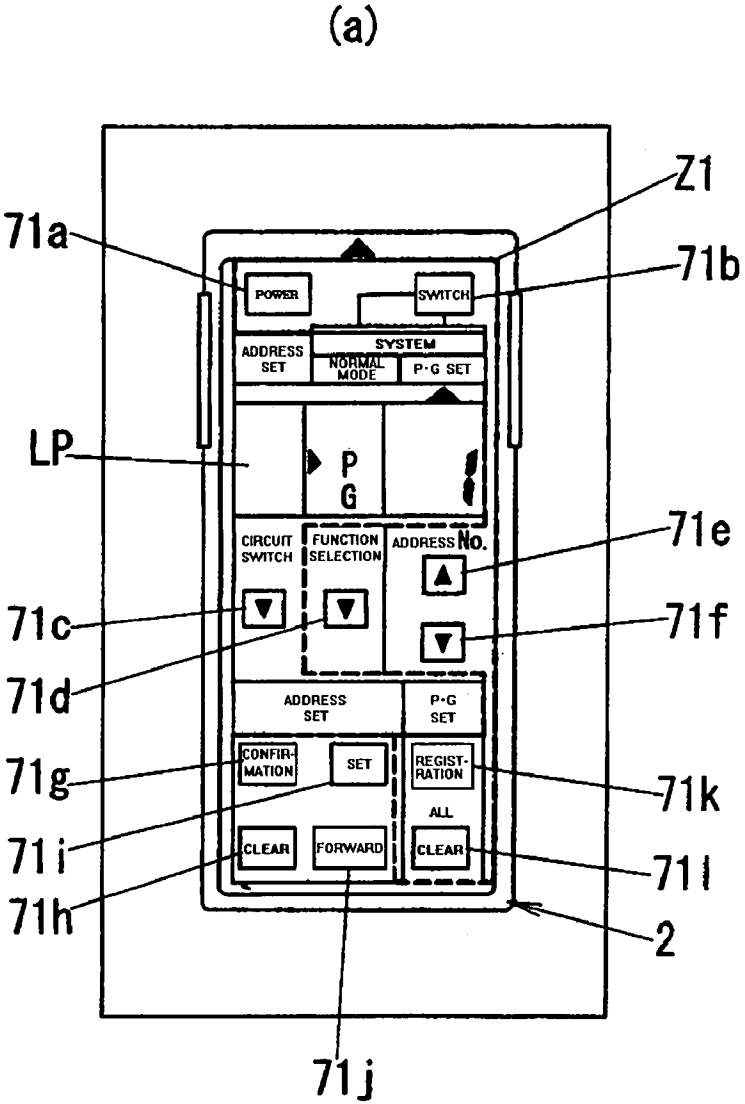

The procedure of setting the address is first described. The address setting is carried out in the state that the portable unit 2 is detached from the stationary unit 1 and the light emitting surface of the light emitting element LD is directed to a light receiving surface (not shown) of the operation device or the control device. The push buttons 71*a* and 71*c* to 71*j* in an area Z2 of FIG. 6(*b*) are used for the address setting. First, when the power button 71*a* is pressed, the controller 22 detects whether the wire transceiver 23 is connected to the signal line L. Here, in detecting whether the wire transceiver 23 is connected to the signal line L, a method that two of the four contacts 51 disposed in the connector 5*a* of the stationary unit 1 are short-circuited and the controller 22 detects that the wire transceiver 23 is connected to the signal line L when two contacts (not shown) of the portable unit 2 in contact with two short-circuited contacts are short-circuited is considered.

When the controller 22 detects that the wire transceiver 23 is not connected to the signal line L, the controller 22 operates in a mode for setting an address. Next, when a confirmation button 71*g* is pressed, the controller controls the optical transmitter 24 to transmit a predetermined confirmation signal to the operation device or the control device by the use of light of the light emitting element LD. When the operation device and the control device receive the confirmation signal, the operation device and the control device transmit an address notifying signal for indicating the set state of address by the use of light.

When the controller 22 receives the address notifying signal through the light receiving element PD and the optical receiver 25, the controller 22 controls the buzzer part 26 to generate a sound (for example, a long sound) notifying the success of communication and controls the liquid crystal display 27 to display the details of the address notifying signal on the liquid crystal panel LP. Next, when a circuit switching button 71*c* is pressed, a circuit number which is a number corresponding to a switch or a load of which an address is set is selected. The circuit number is circularly changed every time the circuit switching button 71*c* is pressed. By pressing a function selection button 71*d*, a pattern or group address as well as an individual address can be set. Next, an address number is selected by the use of address selection buttons 71*e* and 71*f*. At this time, by pressing a forward rotation button 71*j*, a next address can be assigned to a next circuit number. When a clear button 71*h* is pressed, the address set details of the selected circuit number are reset.

When a set button 71*i* is pressed after selection of the address, the controller 22 generates a setting signal indicating a relation between the set circuit number and the set address and controls the optical transmitter 24 to transmit the setting signal to the operation device or the control device by the use of light of the light emitting element LD. When the operation device and the control device receive the setting signal, the operation device and the control device set the relation between the circuit number and the address in response to the setting signal and transmit a predetermined response signal by the use of light. When the controller 22 receives the response signal through the light receiving element PD and the optical receiver 25, the controller controls the buzzer part 26 to generate a sound (for example, a long sound) indicating the success of communication. In this way, the address setting is completed.

When the address notifying signal or the response signal is not received in a predetermined time after the confirmation signal or the setting signal is transmitted, the controller 22 controls the buzzer part 26 to generate a sound (for example, a short sound five times) indicating the failure of communication and controls the liquid crystal display 27 to display data indicating the failure of communication on the liquid crystal panel LP.

Next, the procedure of setting the relation data is described. Push buttons 71*a*, 71*b*, 71*d* to 71*f*, 71*k*, and 71*l* in an area Z1 of FIG. 6(*a*) are used for setting the relation data. The setting of the relation data is carried out in the state that the portable unit 2 is attached to the stationary unit 1. When the power button 71*a* is pressed and it is detected by the controller 22 that the wire transceiver 23 is connected to the signal line L, the controller 22 is activated in a mode for setting the relation data. Then, when the switching button 71*b* is pressed, the controller 22 controls the wire transceiver 23 to transmit a predetermined setting start signal to the transmission controller through the signal line L. When receiving the setting start signal, the transmission unit 14 is switched to the mode for setting the relation data from a normal mode for controlling the relays 14*a* based on the signals from the PG operation device 12 and the individual operation terminal 12.

It is determined by the use of the function selection button 71*d* whether the relation data for pattern control should be set or the relation data for group control should be set. The state in which the relation data for pattern control are set and the state that the relation data for group control are set are changed in turns every time the function selection button 71*d* is pressed. When the kind of the relation data to be set is determined, the address of the switch corresponding to the relation data to be set is selected by the use of the address selection button 71*e* and 71*f*. Here, the switch corresponding to the relation data to be set may be selected by the use of the PG operation device 12. Specifically, when the pattern switches 12*a* or the group switches 12*b* of the PG operation device 12 are operated, the operated pattern switch 12*a* or group switch 12*b* is selected as the switch corresponding to the relation data by the transmission unit 14 and a signal indicating the selected pattern switch 12*a* or group switch 12*b* is input to the controller 22 through the signal line L and the wire transceiver 23 from the transmission unit 14.

When the selection of the switch address is completed, a corresponding load is set by operating the individual switches 13*a* of the individual operation device 13. For example, in the case of the setting of pattern control, Pattern switch ON→Pattern switch OFF→Not control target of pattern switch→Pattern switch ON is repeated whenever the individual switches 13*a* are pressed. In the case of the setting of group control, Control target of group switch→Not control target of group switch→Control target of group switch is repeated whenever the individual switches 13*a* are pressed, and the setting state can be confirmed by the use of the lighting state of a lamp in the indication window 13*b*. Next, when a register button 71*k* is pressed, the controller 22 controls the wire transceiver 23 to transmit a predetermined registration signal to the transmission unit 14 through the signal line L. When receiving the registration signal, the transmission unit 14 updates the relation data in accordance with the operation of the push button 71 of the portable unit 2, the PG operation device 12, or the individual operation device 13 up to that time.

A push button 71 for setting the address or pattern control of a load to be controlled may be formed in the portable unit 2. In this case, the controller 22 generates the relation data in accordance with the operation of the push buttons 71. When the setting is finished and the register button 71*k* is pressed, the controller 22 controls the wire transceiver 23 to transmit the relation data to the transmission unit 14 through the signal line L. When receiving the relation data, the transmission unit 14 changes the setting details in accordance with the received relation data.

By pressing the clear button 17*l* when the transmission unit 14 is in the setting mode, the controller 22 controls the wire transceiver 23 to transmit a predetermined reset signal to the transmission unit 14 through the signal line L. When receiving the reset signal, the transmission unit 14 resets the relation data previously set.

Finally, when the switching button 71*b* is pressed, the controller 22 controls the wire transceiver 23 to transmit a predetermined setting end signal to the transmission unit 14 through the signal line L. When receiving the setting end signal, the setting mode is switched to a normal mode, the transmission unit 14 resumes the control of the relays 14*a* based on the monitoring data transmitted from the PG operation device 12 and the individual operation terminal 13.

According to the configuration described above, by forming the coupling concave portions 41*d* for coupling to the stationary unit 1 in the battery receiving portion 41*c* of the portable unit 2, it is possible to decrease the size of the portable unit 2, in comparison with the case that a portion to be coupled to the stationary unit 1 is prepared at a place other than the battery receiving portion 41*c*.

Both of the setting of an address corresponding to a switch in the operation device or an address corresponding to a load in the control device and the setting of the relation data in the transmission controller are possible. When the address setting is not performed, the portable unit 2 can be kept attached to the stationary unit 1. Accordingly, even when a specific space is additionally prepared, the portable unit 2 is little lost.

Figure 7:
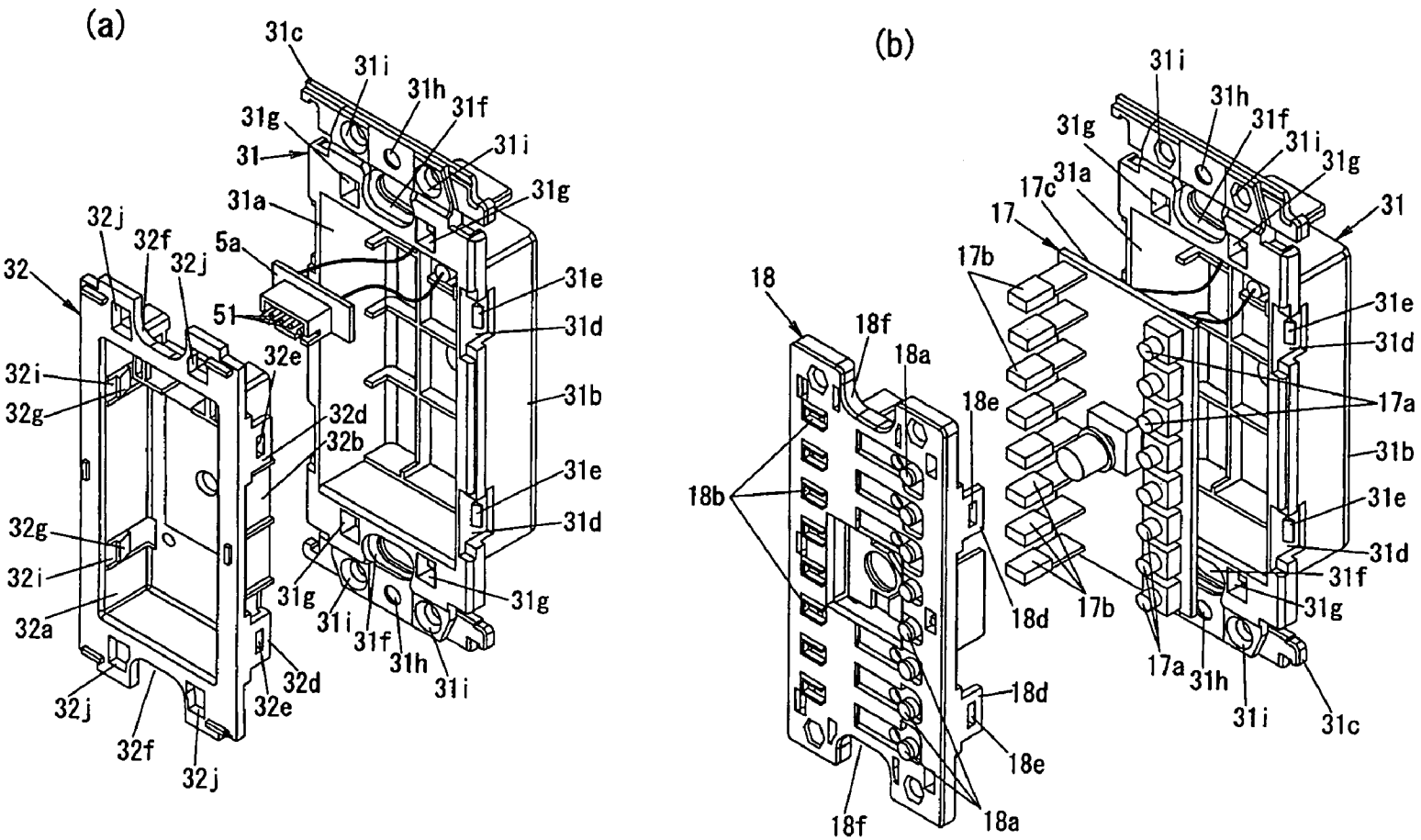
FIG. 7(*a*) is an exploded perspective view illustrating a stationary unit according to another modified example of the embodiment and FIG. 7(*b*) is a perspective view illustrating a base body and an operation device attached to the base body according to the modified example of the embodiment.

The shapes of the stationary unit 1 and the portable unit 2 are not limited to the above-mentioned description, but the shapes of the base body 31 and the base cover 32 of the stationary unit 1 may be as shown in FIG. 7(*a*). In the example shown in FIG. 7(*a*), holes 32*j* for forwardly exposing the hooking holes 31*g* are formed. In addition, by opening the back side of the coupling convex portions 32*g* and making the rear ends of the bending portions 32*i* be free ends, the bending portions 32*i* can be more easily bent.

Since the base 3 of the stationary unit 1 according to the exemplary embodiment includes the base body 31 and the base cover 32, the base body 31 may be used to attach the operation device 17, the size of which is greater than that of the battery receiving portion 41*c* of the portable unit 2 as shown in FIG. 7(*b*), to the installation surface. The operation device 17 includes a plurality of push button switches 17*a* (eight in the figure) corresponding to the loads, a plurality of light emitting diodes 17*b* for indicating the operation states of the loads corresponding to the push button switches 17*a*, and a printed circuit board 17*c* which is slightly smaller than the receiving concave portion 32*a* and is mounted with the push button switches 17*a* and the light emitting diodes 17*b*. The printed circuit board 17*c* is connected to the transmission unit 14 through the signal line L and when a push button switch 17*a* is operated, the transmission unit 14 turns on or off the load corresponding to the operated push button switch 17*a*. A switch cover 18 is attached to the front side of the operation terminal 17. The switch cover 18 is provided with a plurality of push button handlebars 18*a* which can be displaced forward and backward with respect to the other portions so at to deliver the applied force to the push button switches 17*a* and correspond to the push button switches 17*a*, a plurality of window holes 18*b* for forwardly exposing the light emitting surface of the light emitting diodes 17*b*, respectively, and coupling pins 18*d*, coupling holes 18*e*, notched portions 18*f* similar to the coupling pieces 32*d*, the coupling holes 32*e*, and the notched portions 32*f* of the base cover 32.

Figure 8:
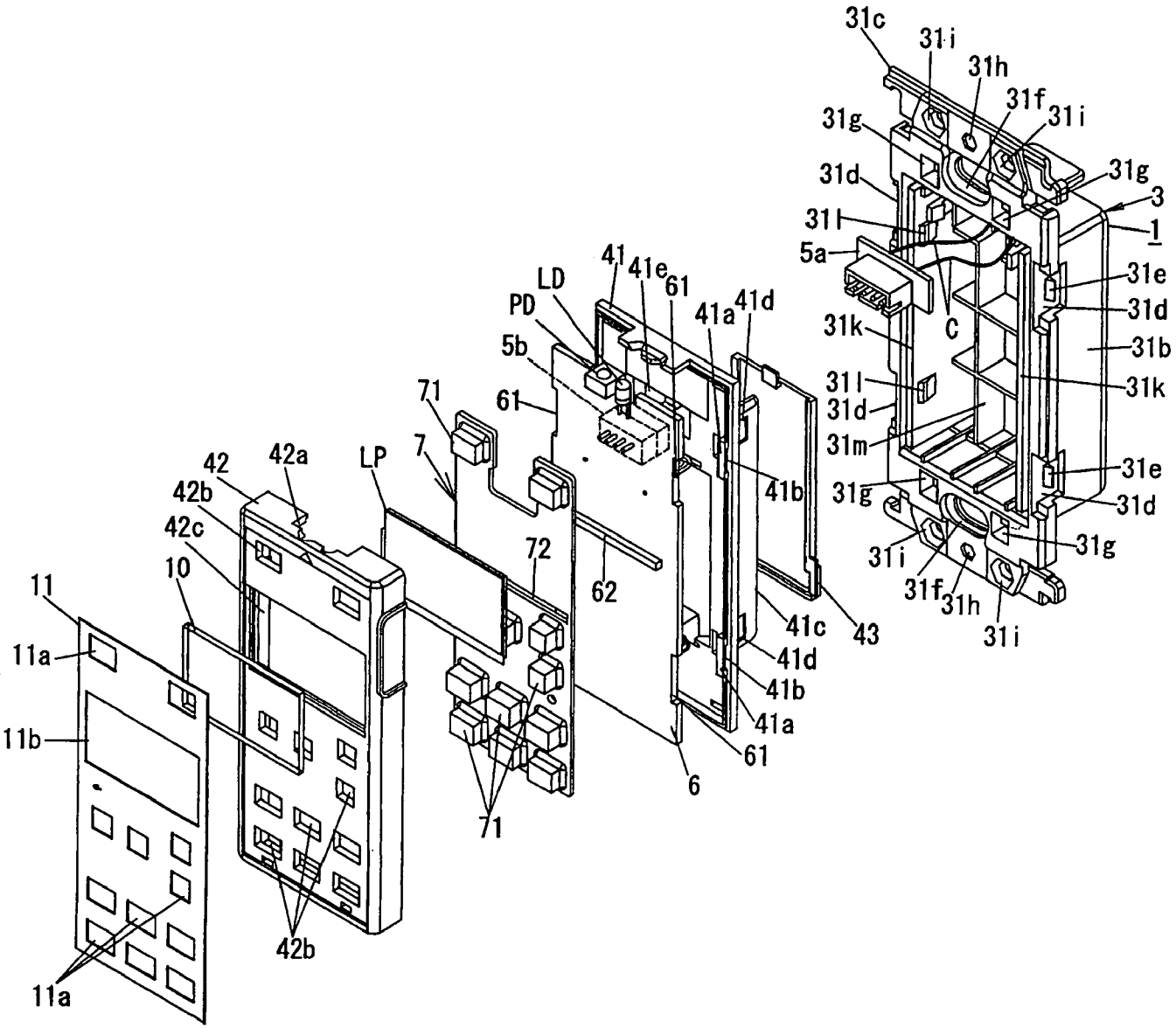
FIG. 8 is an exploded perspective view illustrating another modified example of the embodiment.

The base 3 may be formed out of only one synthetic resin molded product as shown in FIG. 8, instead of the base body 31 and the base cover 32. In the example shown in FIG. 8, the base 3 is formed out of only a body 31 and two bending portions 31*k* which can be laterally bent and are opposed to each other with the battery receiving portion 41*c* of the portable unit 2 therebetween are protruded forwardly from the bottom of the receiving concave portion 31*a* of the base body 31. In addition, coupling convex portions 31*l* inserted into the coupling concave portions 41*d* of the portable unit 2 are protruded inwardly from the opposed surfaces of the bending portions 31*k*. The gap between the bending portions 31*k* is slightly greater than the lateral width of the battery receiving portion 41*c*. A rib 31*m* for coming in contact with the battery receiving portion 41*c* to stabilize the posture of the portable unit 2 is protruded inwardly from the inner surface of the receiving concave portion 31*a*. By employing this configuration, it is possible to decrease the number of parts of the stationary unit 1, thereby reducing the manufacturing cost.

Figure 9:
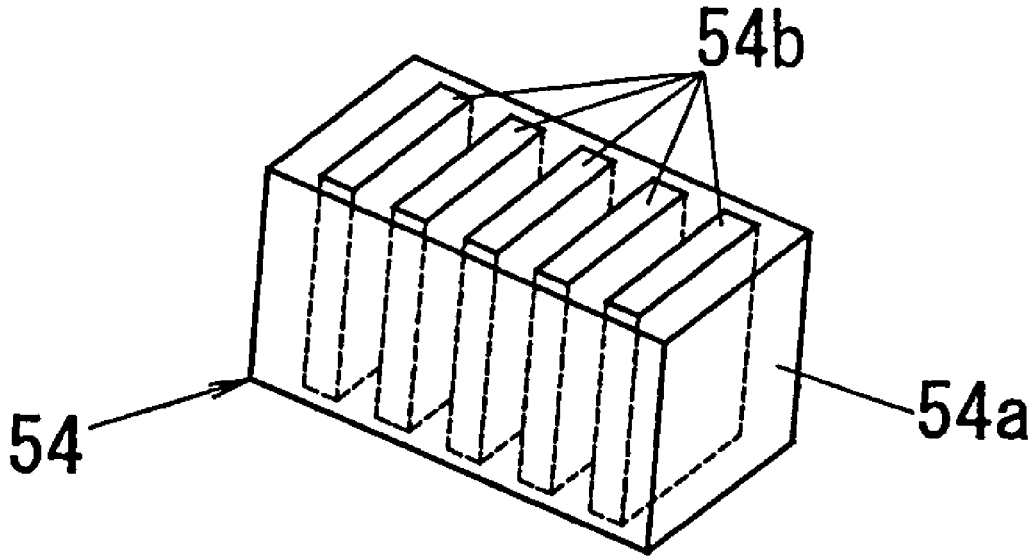
FIG. 9 is a perspective view illustrating a rubber connector used for another modified example of the embodiment.
Figure 10:
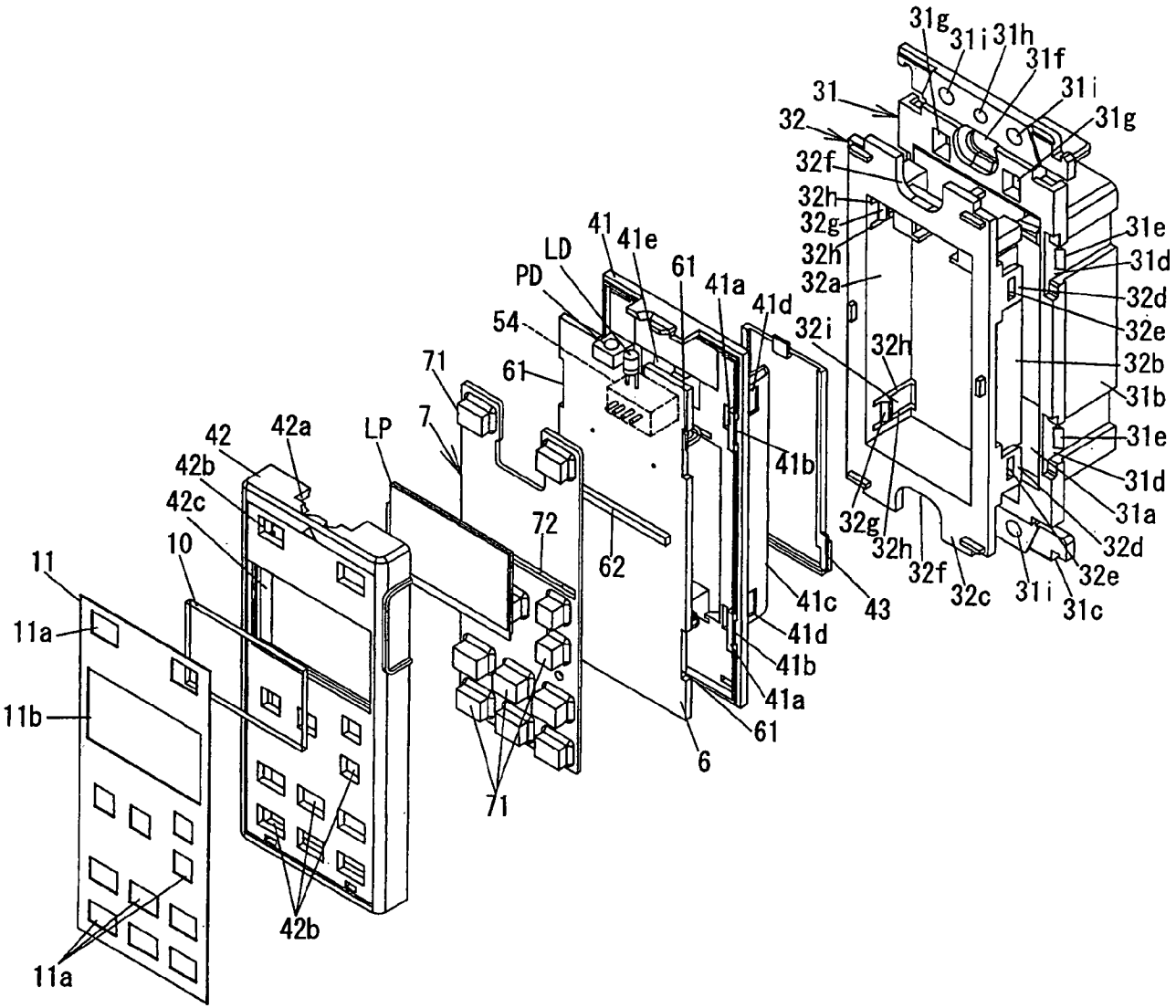
FIG. 10 is an exploded perspective view illustrating another modified example of the embodiment.
Figure 11:
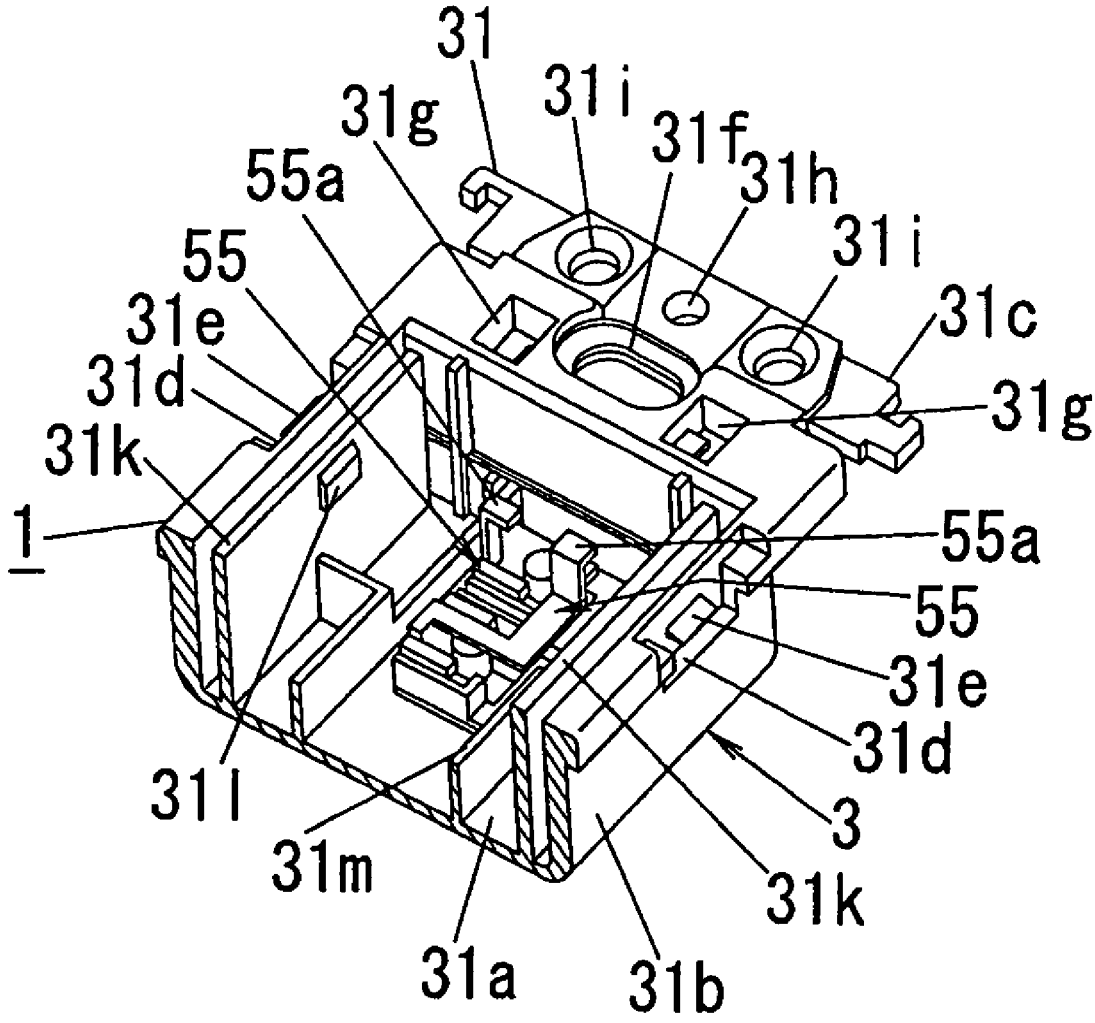
FIG. 11 is a partially exploded perspective view illustrating a stationary unit according to another modified example of the embodiment.
Figure 12:
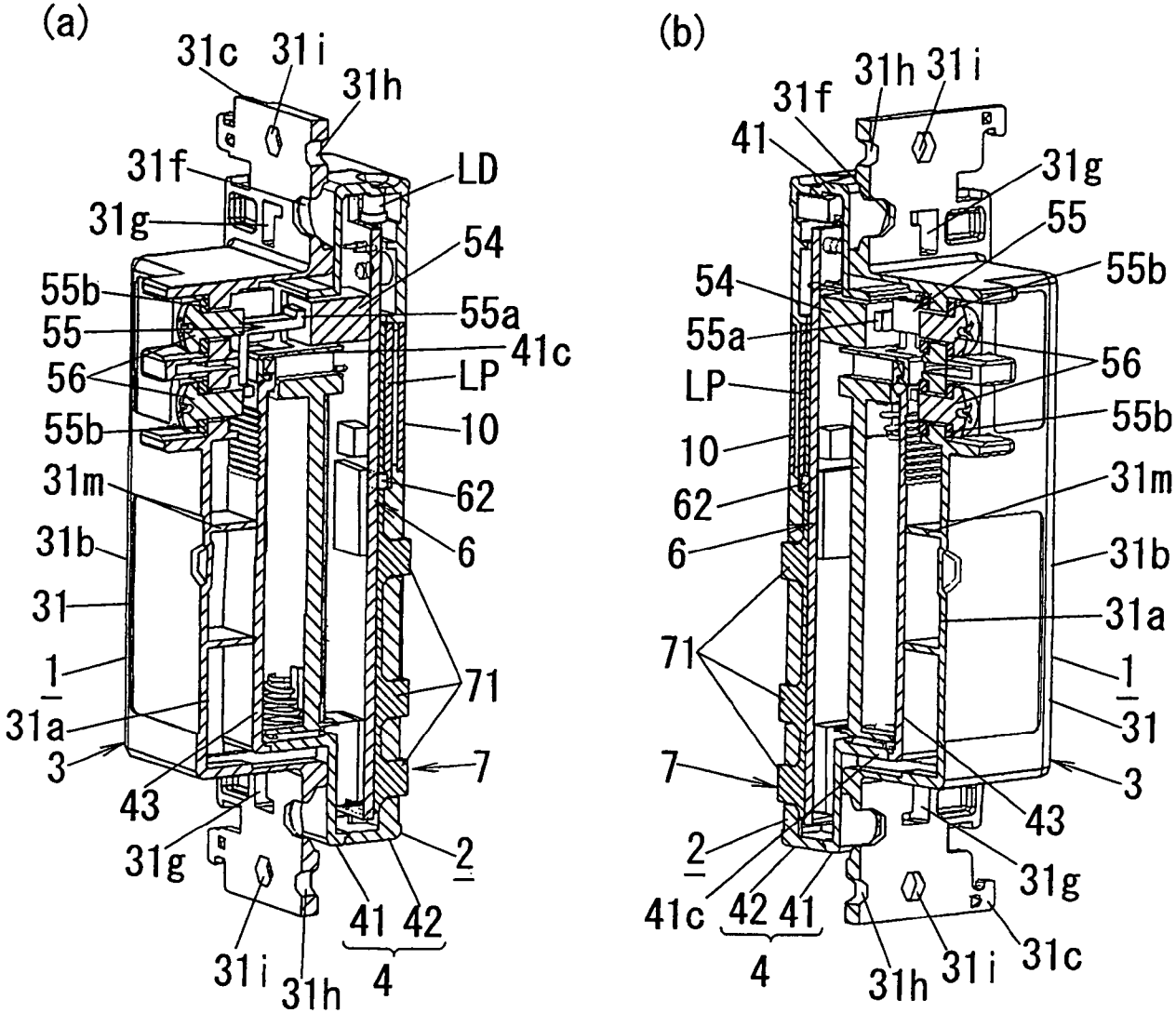
FIGS. 12(*a*) and 12(*b*) are partially exploded perspective views illustrating another modified example of the embodiment, which illustrate opposite sides of a cutting plane.

As shown in FIG. 9, a flexible rubber connector 54 including an insulating part 54*a* made of insulating rubber and formed in, for example, a rectangular hexahedron shape and a plurality of conductive parts 54*b* (five in FIG. 9) made of conductive rubber and exposed to both surfaces opposed to each other of the insulating part 54*a* may be used as both or one of the connection means. An example that the rubber connector 54 as the connection means is mounted on the printed circuit board 6 of the portable unit 2 instead of the connector 5*b* is shown in FIGS. 10 to 12. In the configuration shown in FIG. 10, a printed circuit board (not shown) provided with a conductive pattern electrically connected to the conductive parts 54*b* of the rubber connector 54 is fitted into the receiving concave portion 32*a* of the base cover 32. In the configuration shown in FIGS. 11 and 12, a terminal plate 55 made of a metal plate is fixed to the base 3 by inserting the terminal plate into the hole formed through the bottom of the receiving concave portion 31*a* in the caulking manner. The terminal plate 55 includes contact portions 55*a* coming in contact with the conductive parts 54*b* exposed from the rear surface of the rubber connector 54 and terminal portions 55*b* in which screw holes for screw-coupling with terminal screws 56 are formed and which are exposed from the rear side of the base 3 and constitute screw terminals along with the terminal screws 56. In this way, by using the flexible rubber connector 54 for both or one of two connection means, even when the attachment and detachment of the portable unit 1 are repeated, the connection means is less deteriorated, in comparison with the case that the connection means is not flexible.

Since the coupling portion to be coupled to the coupling portion disposed on the inner circumferential surface of the receiving concave portion of the stationary unit is disposed on the outer circumferential surface of the battery receiving portion which is disposed in the portable unit with the outer circumferential surface slightly smaller than the inner circumferential surface of the receiving concave portion and which is received in the receiving concave portion with the battery received therein, it is possible to further decrease the size of the portable unit, compared with the case that the portion of the portable unit in which the coupling portion is displaced is provided at a position other than the battery receiving portion.

What is claimed is:

1. A setting apparatus for a remote monitoring and controlling system, comprising:

an operation device having switches in which a specific address is set for each switch; a control device connected with loads in which a specific address is set for each load, and a transmission controller which transmits and receives a transmission signal between the operation device and the control device through a signal line to which the operation device and the control device are branched in manner of a time division multiple transmission, generates control data for controlling the loads based on monitoring data received from the operation device when the switches are operated, and transmits control data to the control device connected with the loads associated with the operated switches on the basis of predetermined relation data, wherein the setting apparatus is connected to the signal line, generates the relation data for controlling simultaneously a number of loads by operation of one switch, and sets the relation data by transmitting the relation data to the transmission controller, wherein the setting apparatus comprises a stationary unit fixed to an installation surface and a portable unit which is detachably attached to the stationary unit and can be carried by detaching the portable unit from the stationary unit, wherein the stationary unit includes a base having a receiving concave portion for receiving a part of the portable unit at least in the state that the portable unit is attached to the stationary unit and a fixing portion fixed to the installation surface, and a first connector for electrically connecting the portable unit to the signal line, wherein the portable unit includes an inputter for inputting addresses and the relation data by manual operation, a controller for generating the addresses and the relation data on the basis of the input to the inputter, a wireless transmitter for transmitting the addresses to the operation device and the control device as a radio signal under the control of the controller, a second connector electrically connected to the signal line through the first connector of the stationary unit in the state that the portable unit is attached to the stationary unit, a wired transmitter for transmitting the relation data to the transmission controller through the first connector of the stationary unit, the second connector of the portable unit, and the signal line under the control of the controller, and a housing which receives a battery for supplying power to the respective portions of the portable unit and the controller and exposes the inputter at an exposing position in the state that it is fixed to the base of the stationary unit, wherein the housing includes a battery receiving portion for receiving the battery and an outer circumferential surface which has a size slightly smaller than the inner circumferential surface of the receiving concave portion formed at the base of the stationary unit to be received in the receiving concave portion in the state that the portable unit is attached to the stationary unit, and wherein a first coupling portion is provided on the inner circumferential surface of the receiving concave portion, a second coupling portion is provided on the outer circumferential surface of the battery receiving portion, and the housing of the portable unit is detachably attached to the base of the stationary unit by the coupling between the coupling portions.

2. The setting apparatus according to claim 1, wherein the base of the stationary unit includes a base body being provided with the fixing portion and being fixed to the installation surface and a base cover having a receiving concave portion formed therein, and the base body and the base cover are detachably coupled to each other by the use of coupling provided in at least one of the base cover and the base body.

3. The setting apparatus according to claim 2, wherein the coupling portion of the base includes a coupling convex portion protruded to the inside of the receiving concave portion from the inner circumferential surface of the receiving concave portion and the coupling portion of the housing includes a coupling concave portion provided on the outer circumferential surface of the battery receiving portion.

4. The setting apparatus according to claim 1, wherein the base of the stationary unit includes only one component.

5. The setting apparatus according to claim 4, wherein the coupling portion of the base includes a coupling convex portion protruded to the inside of the receiving concave portion from the inner circumferential surface of the receiving concave portion and the coupling portion of the housing includes a coupling concave portion provided on the outer circumferential surface of the battery receiving portion.

6. The setting apparatus according to 1, wherein the coupling portion of the base includes a coupling convex portion protruded to the inside of the receiving concave portion from the inner circumferential surface of the receiving concave portion and the coupling portion of the housing includes a coupling concave portion provided on the outer circumferential surface of the battery receiving portion.

* * * * *